US005787612A

United States Patent [19]

Mahoney et al.

[11] Patent Number: 5,787,612

[45] Date of Patent: Aug. 4, 1998

[54] SNOWSHOE WITH HEEL ENTRAPMENT BINDING AND INTEGRAL HEEL CRAMPON ASSEMBLY

[75] Inventors: Francis E. Mahoney, Goffstown, N.H.; Daniel P. Kiniry, Shelburne, Vt.

[73] Assignee: Tubbs Snowshoe Company, Stowe, Vt.

[21] Appl. No.: 805,362

[22] Filed: Feb. 24, 1997

[51] Int. Cl.[6] ..... A43B 5/04; A43B 5/16

[52] U.S. Cl. ..... 36/124; 36/122

[58] Field of Search ..... 36/122, 123, 124, 36/125

[56] References Cited

U.S. PATENT DOCUMENTS

| | | | |
|---|---|---|---|
| 3,000,117 | 9/1961 | Howe | 36/125 |
| 4,085,529 | 4/1978 | Merrifield | 36/125 |
| 4,348,823 | 9/1982 | Knapp et al. | 36/124 X |
| 5,259,128 | 11/1993 | Howell | 36/122 |
| 5,341,582 | 8/1994 | Liautaud | 36/124 X |
| 5,480,176 | 1/1996 | Sims | 280/618 |
| 5,517,772 | 5/1996 | Anderson | 36/122 |
| 5,540,002 | 7/1996 | Liautaud | 36/122 |

*Primary Examiner*—B. Dayoan
*Attorney, Agent, or Firm*—Ross,Ross & Flavin

[57] ABSTRACT

A snowshoe incorporates a semi-rigid boot housing assembly which encloses the boot of a user on either side and bottom of the foot, and an integral heel crampon assembly which precludes deflection of the snowshoe flotation member and heel crampons by ensuring that the downward force of a user's weight is transmitted directly to the crampons whereby the crampons remain perpendicular to the snow surface, the boot housing assembly extending to the heel area and upward to the ankle area and including an adjustable heel stop assembly attached to the housing for ensuring that the ball of the foot is positioned directly over the snowshoe axle, the housing assembly having semi-rigid side walls which extend the lateral rigidity to the ankle area, and provide a tension member to resist foot movement during descents, the housing walls being designed to comfortably restrain the foot using an instep clamp assembly, the boot housing assembly including a width adjustment system which allows the user to pre-set the proper width in the "ball-of-foot" area and having a rugged ratchet strap assembly with actuating lever which allows the user to exert substantial binding force toward the heel stop assembly.

18 Claims, 5 Drawing Sheets

SNOWSHOE WITH HEEL ENTRAPMENT BINDING AND INTEGRAL HEEL CRAMPON ASSEMBLY

BACKGROUND OF THE INVENTION

1. Field of the Invention

The invention relates to an improved snowshoe binding and heel crampon assembly.

2. Description of the Prior Art

Snowshoe bindings of the prior art, such as disclosed in U.S. Pat. No. 5,259,128, utilize some type of adjustable harness to wrap around the toe area of the boot (toe entrapment). The initial toe harness adjustment is usually somewhat tedius and must be repeated for each change in boot size. The toe entrapment means must accommodate a wide range of boot sizes, requiring the binding to be constructed from flexible "straplike" materials. The flexible nature of the binding materials prevents the binding from providing lateral rigidity.

As mentioned in U.S. Pat. No. 5,259,128, the heel retainer straps have little effect on resisting the tendency of the heel to slip downhill (laterally) when traversing a slope. When traversing a slope, the center of gravity of the hiker is located some four to eight inches to the rear of the pivot point (toe cord). From an engineering viewpoint, a couple is created which becomes greater with foot size, weight, and slope angle. With the prior art (toe entrapment), this couple must be overcome with flexible materials located over the toe cord.

Most modern hiking boots have a lacing means which secures the heel to the back of the boot. The object is to prevent the toe from contacting the front of the boot during descents. As boots wear the lacing means tends to fail resulting in a painful condition known to hikers as "black toe" and sometimes resulting in toenail loss.

Binding systems of the prior art entrap the toe, and actually add foot pressure toward the toe, worsening this tendency.

The flexible materials used with existing bindings, have a tendency to slip, stretch, and loosen in use. Many of the bindings must be continually tightened in the field, requiring the user to remove gloves and suffer discomfort.

During the past decade there has been a dramatic evolution in the design of snowshoes. One of the major aspects of the evolution has been a trend to replace "natural" materials (wood, animal hides), with synthetic components (aluminum, plastics). The evolution has improved strength, reduced weight, and added ergonomic benefits to the snowshoe.

Manufacturers soon found that the synthetic materials were naturally slippery in the snow, and features were added to the snowshoe assembly to inhibit the tendency for the snowshoe to slide. One of the first innovations was the addition of a pivoting metallic cleat mounted to the "toe cord", (directly under the ball of the foot), which aided the user in ascent and descent situations. The "toe cord cleat" was a good improvement, but lacked stability in certain slope traversing situations.

The next step in the evolution was the addition of cleats under the heel area of the snowshoe. There have been several approaches to incorporating snowshoe mounted cleats. Worthy of mention are: (a) systems which mount cleats on the flotation membrane, and (b) systems which utilize multiple cleats and locate the cleats within close proximity of the frame.

These systems improve the anti-slide condition, but have distinct shortcomings. Since the flotation membrane is not a rigid mounting surface, as pressure is applied to the cleat, there is a tendency to deform the floatation member, and change the cleat angle and reduce the snow penetration. Cleats mounted near the frame must depend upon the frame member distributing the downward force. The most direct method of transmitting the downward force is directly under the heel. In most snowshoe construction, the floatation membrane undergoes maximum angular deflection near the frame.

SUMMARY OF THE INVENTION

The snowshoe binding and integral heel crampon assembly of the invention not only retains the boot heel, but offers a means to enhance the action of preventing "black toe" and incorporates a semi-rigid boot housing assembly which encloses the boot on either side and bottom of the foot, extending to the heel area and upward to the ankle area and an integral heel crampon assembly which includes a heel plate, heel band and crampons so assembled and arranged as to transmit the downward force of the user's weight directly to the crampons, thereby ensuring that the crampons remain perpendicular to the snow surface while transmitting vertical and horizontal forces to the snowshoe frame.

The boot housing assembly includes a platform section which extends the lateral rigidity from the snowshoe axle to the heel area and an adjustable heel stop assembly which is attached to the housing. The heel stop assembly ensures that the ball of the foot is positioned directly over the snowshoe axle. The housing assembly also has semi-rigid side walls which (1) extend the lateral rigidity to the ankle area, and (2) provide a tension member to resist foot movement during descents. The housing walls are designed to comfortably restrain the foot using an instep clamp assembly. The foot restraint loading force is applied perpendicular to the boot upper (instep) surface. This restraint angle can vary from 30° to 45° degrees from horizontal.

The binding hereof includes a width adjustment system which allows the user to pre-set the proper width in the "ball-of-foot" area. The binding has sets of spaced ratchet teeth in close proximity to adjustment slots. The ratchet teeth intermesh with mating ratchet teeth on an adjustment plate. The entire assembly is held together with screws which pass through the adjustment plate, through the slots in the binding body, and through clearance holes in a cleat, to locking nuts. By loosening the screws, the user may adjust the semi-rigid binding side walls to be snug with the boot. This would be considered a one time set-up for a new user.

The binding of the invention incorporates a rugged ratchet strap assembly with actuating lever which allows the user to exert substantial binding force toward the heel stop assembly. A retainer clip is used in conjunction with a ratchet strap, to adjust for boot size changes. A locking toggle buckle assembly is used to tighten and lock the binding. The system is easily adjusted from snug fit used on flat ground, to a tight fit for steep descents. A "comfort" pad is provided to prevent discomfort in the instep area.

The invention successfully addresses the problems of lateral support, east of mounting, foot (boot) retention, and flotation member/heel crampon deflection.

DESCRIPTION OF THE PREFERRED EMBODIMENT

Figure 1:
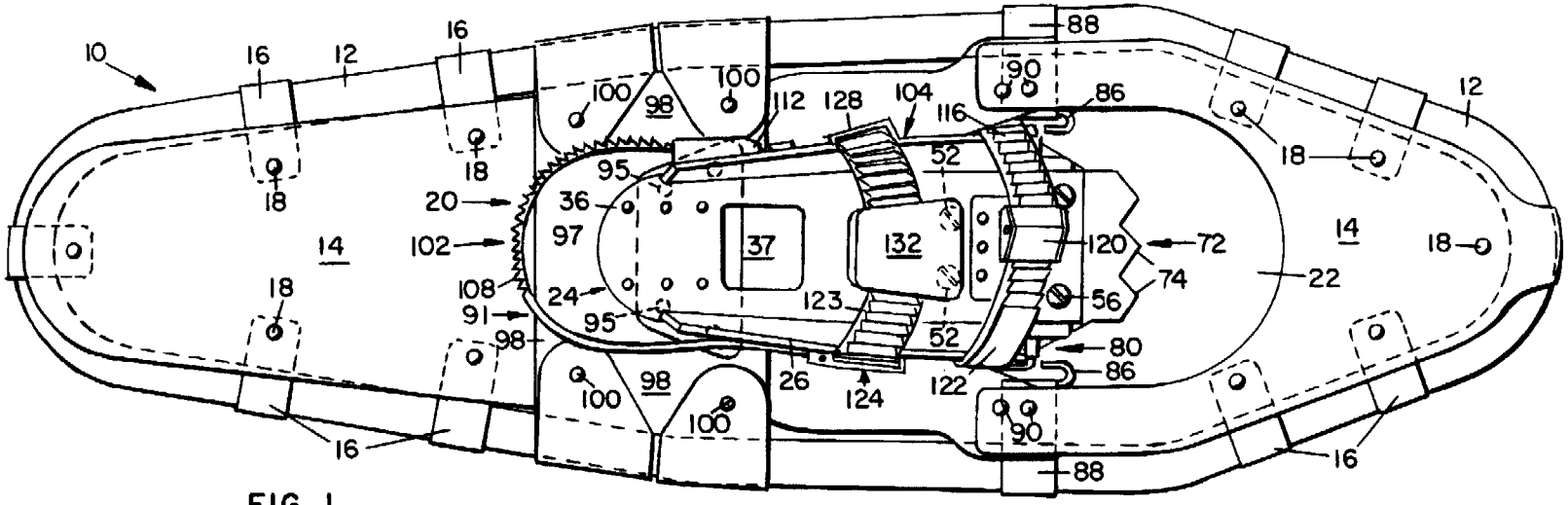
FIG. 1 is a top plan view of a snowshoe with an improved heel entrapment binding and integral heel crampon assembly embodying the invention.
Figure 2:
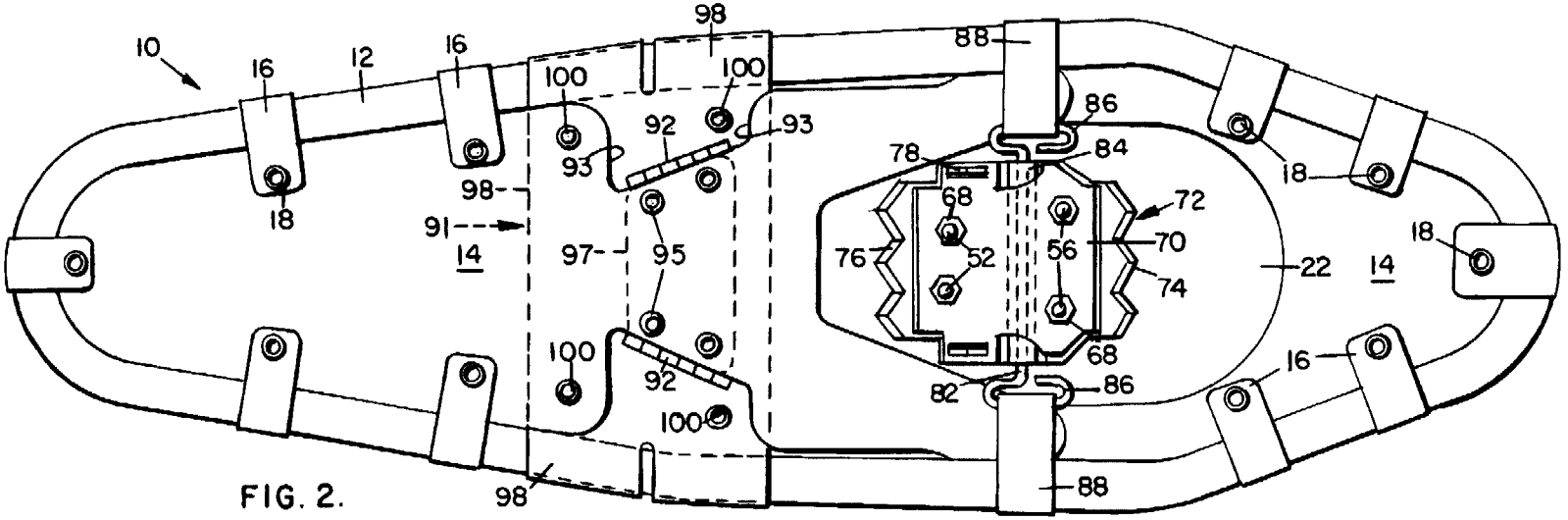
FIG. 2 is a bottom plan view of the snowshoe of FIG. 1.
Figure 3:
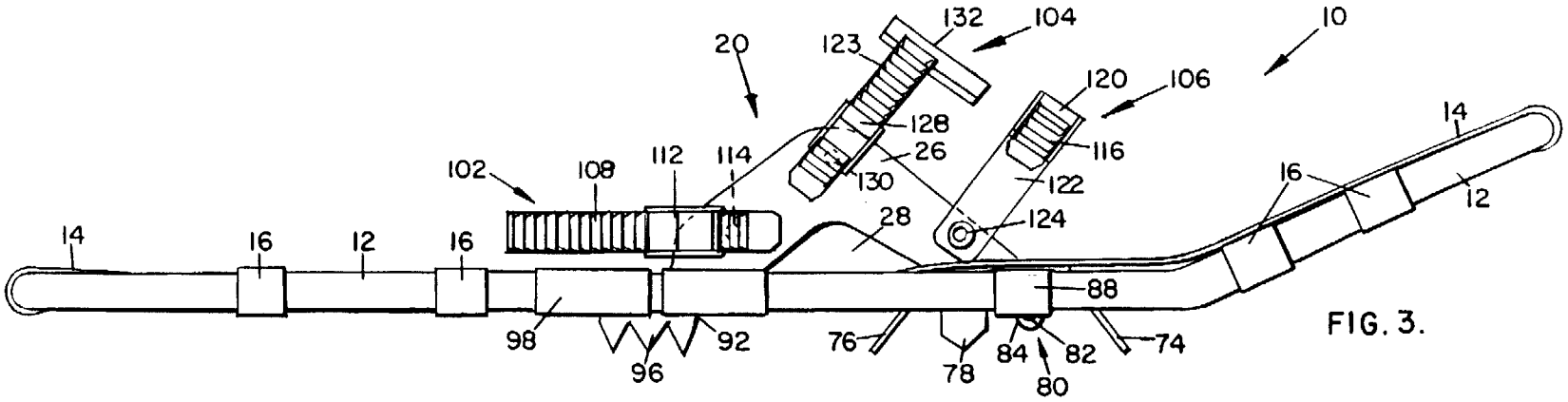
FIG. 3 is a side elevational view of the snowshoe of FIG. 1.
Figure 4:
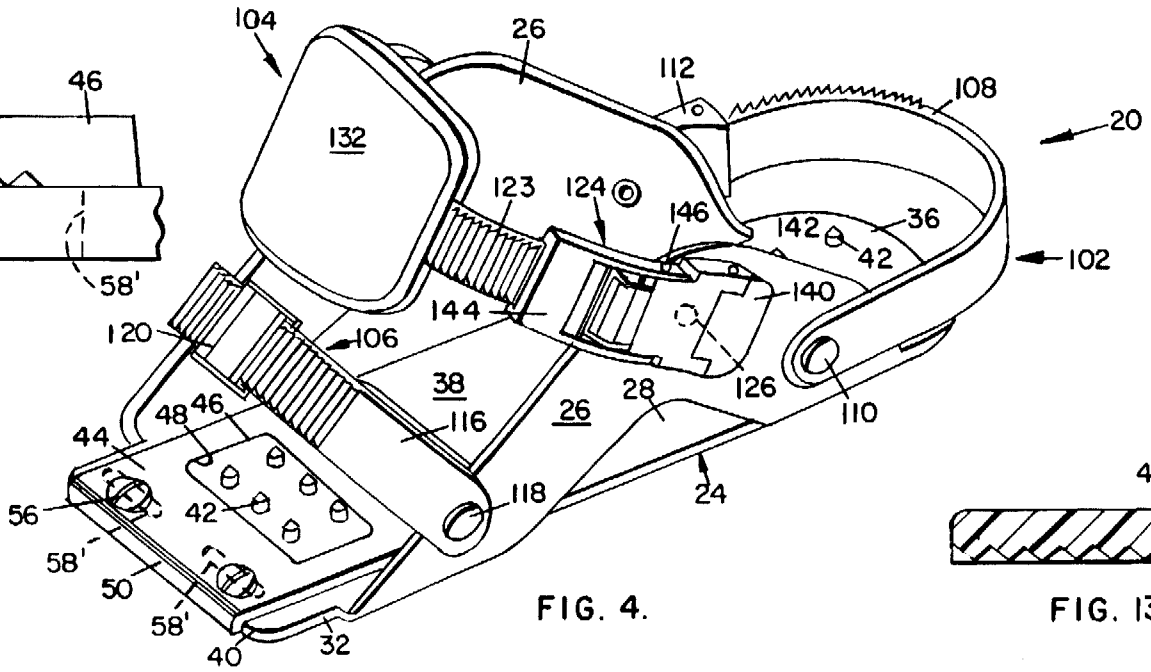
FIG. 4 is an enlarged, top perspective view of the improved heel entrapment binding embodying the invention.
Figure 13:
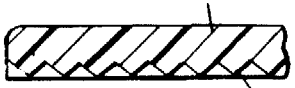
FIG. 13 is an enlarged, fragmentary, cross-sectional view of the adjustment plate taken on line 13—13 of FIG. 9.
Figure 12:
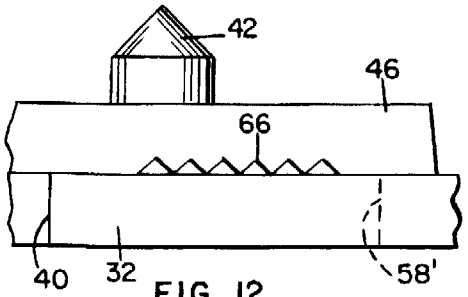
FIG. 12 is an enlarged, fragmentary view of a portion of the boot housing assembly taken on line 12—12 of FIG. 8.
Figure 5:
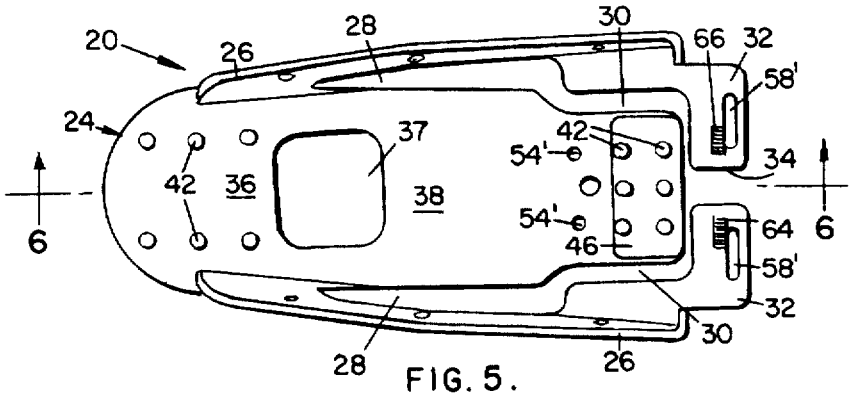
FIG. 5 is a top plan view of the boot housing assembly of the entrapment binding of FIG. 4, with parts omitted for clarity.
Figure 6:
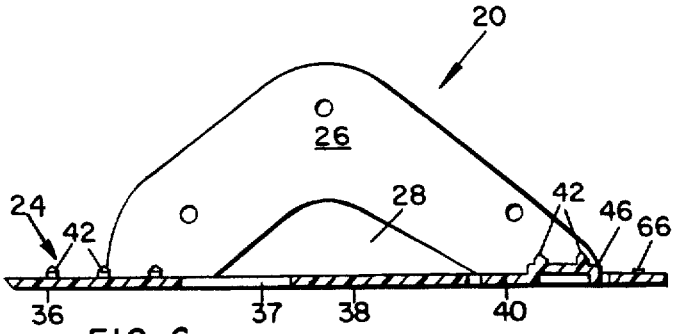
FIG. 6 is a cross sectional view taken on line 6—6 of FIG. 5.
Figure 7:
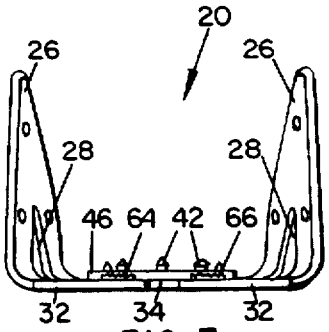
FIG. 7 is an end elevational view of the boot housing assembly of FIG. 5.
Figure 8:
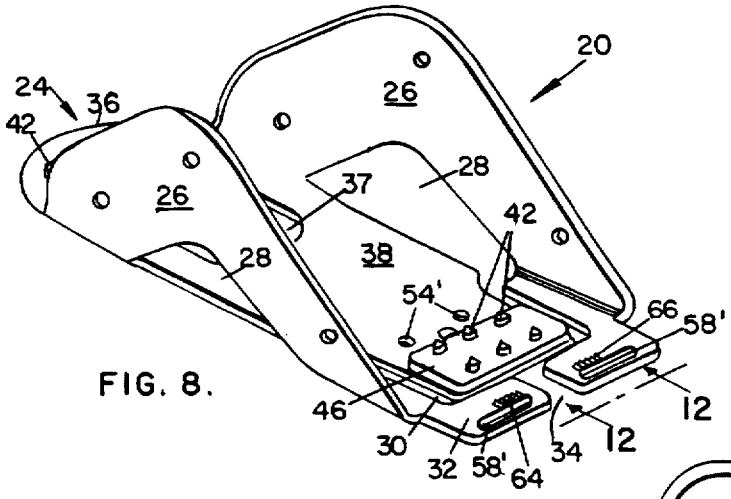
FIG. 8 is a top perspective view of the boot housing assembly of FIG. 5.
Figure 9:
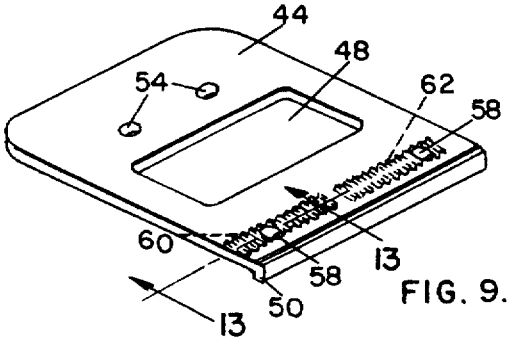
FIG. 9 is a top perspective view of the adjustment plate of the boot housing assembly of FIG. 4.
Figure 10:
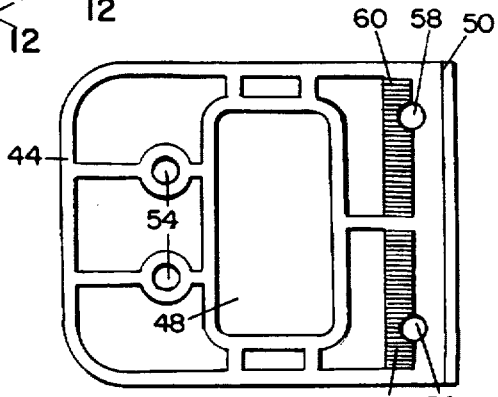
FIG. 10 is a bottom plan view of the adjustment plate of FIG. 9.
Figure 11:
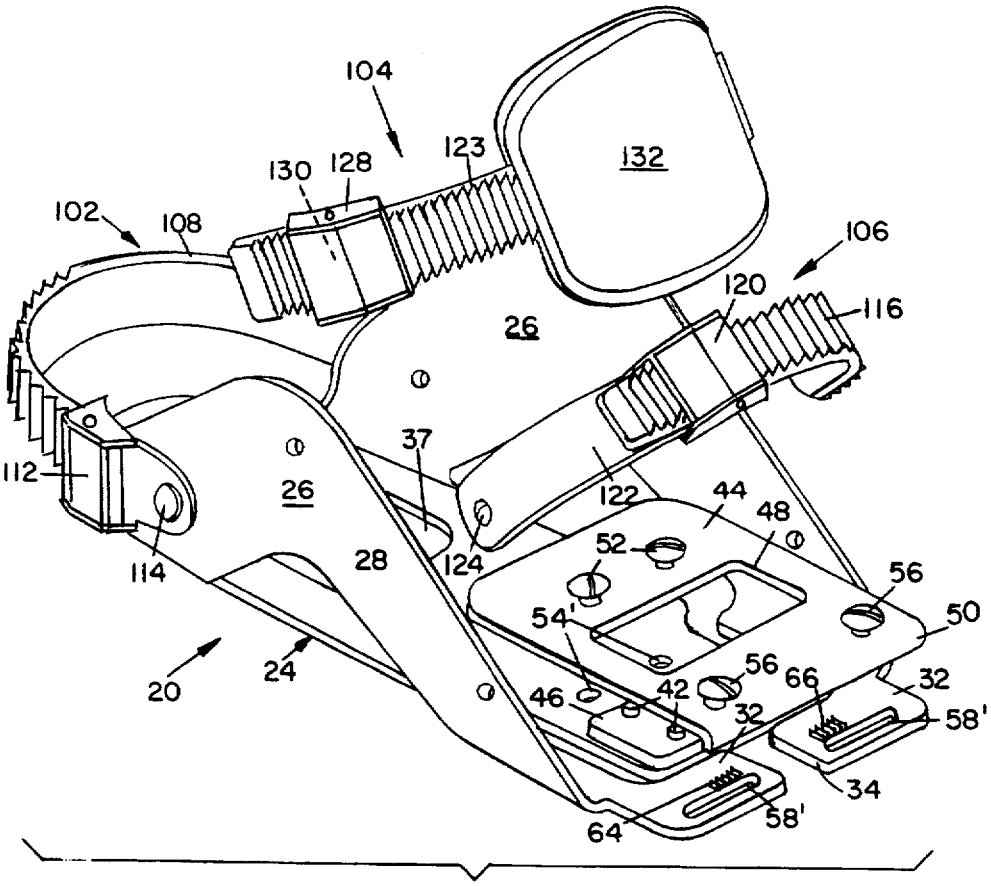
FIG. 11 is an exploded, top perspective view of the boot housing assembly and adjustment plate of the invention.
Figure 14:
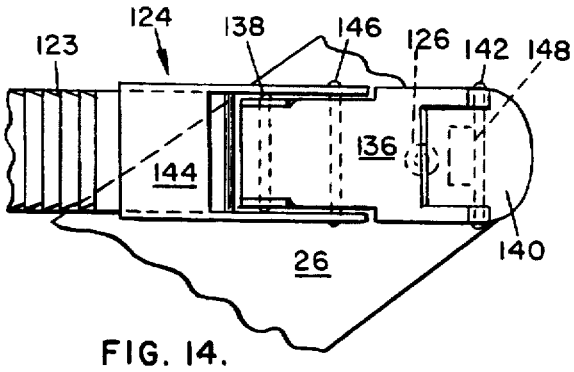
FIG. 14 is an enlarged, front elevational view of the toggle buckle/actuating lever and latch assembly of the instep clamp unit of the invention in a latched position.
Figure 16:
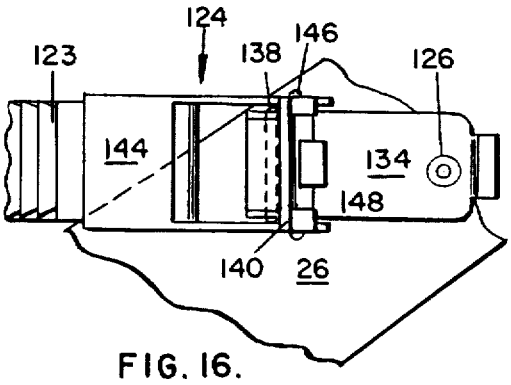
FIG. 16 is a front elevational view of the toggle buckle/actuating lever and latch assembly of FIG. 14 in an unlatched position.
Figure 15:
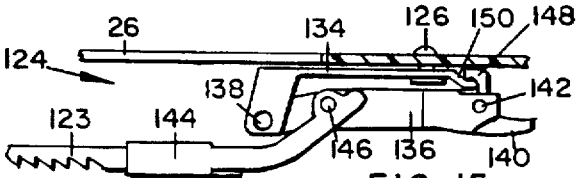
FIG. 15 is a top plan view of the toggle buckle/actuating lever and latch assembly of FIG. 14.
Figure 17:
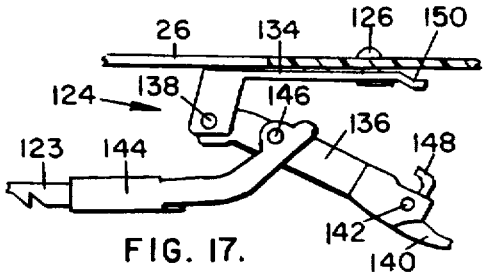
FIG. 17 is a top plan view of the toggle buckle/actuating lever and latch assembly of FIG. 16 in a partially unlatched position.
Figure 18:
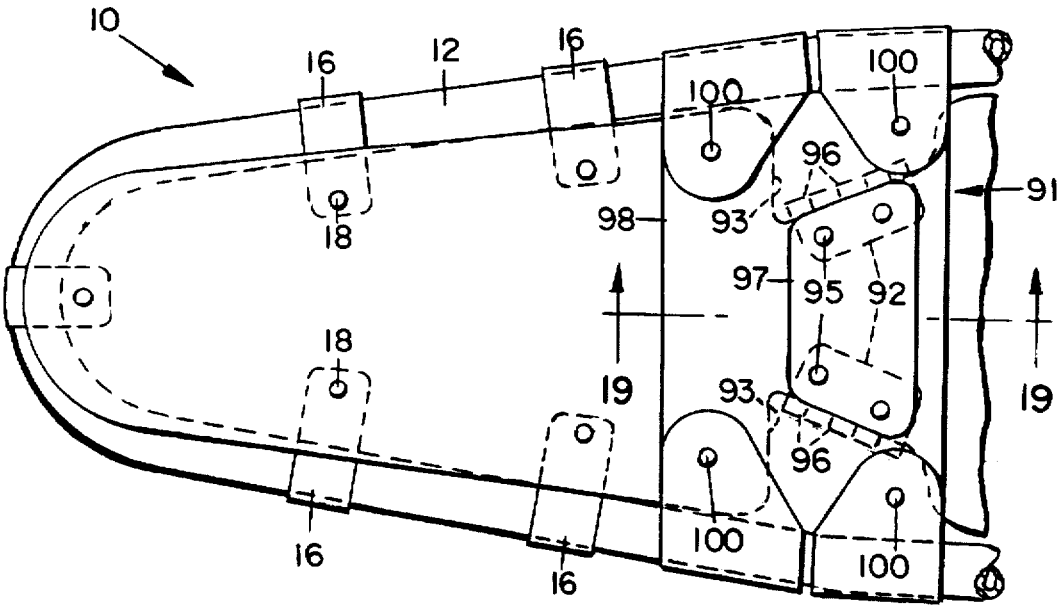
FIG. 18 is a fragmentary top plan view of the snowshoe of FIG. 1 with the boot housing assembly removed to better illustrate the integral heel crampon assembly of the invention.
Figure 19:
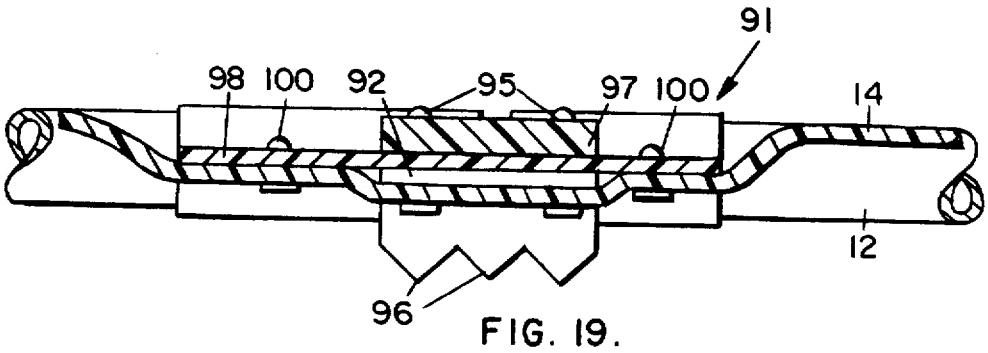
FIG. 19 is an enlarged cross sectional view taken on line 19—19 of FIG. 18.

Referring to FIGS. 1–3, a snowshoe 10 includes a tubular metal, or plastic, or wood frame 12 of conventional shape, having a resilient deck 14 fabricated from plastic sheeting or the like stretched thereacross and attached thereto at spaced intervals as by straps or ties 16 which partially encircle the frame and are attached to the deck by such as rivets 18.

A semi-rigid boot housing assembly 20 is pivotally attached to frame 10 and is positioned on the upper surface of deck 14 at the approximate midpoint of the central longitudinal axis of snowshoe 10.

An opening 22 of appropriate size and configuration is provided approximately centrally of deck 14 for permitting downward pivotal movement of the forward end of boot housing assembly 20 for purposes to appear.

Boot housing 20 is of appropriate size and configuration to support a boot, not shown, and is preferably fabricated from a hard, durable plastic material and includes a substantially flat, rectangular, rigid foot bed plate or platform 24 and a pair of spaced semi-rigid, longitudinally-extending side walls 26, 26 which are formed integrally with foot bed plate 24 and extend vertically upwardly from each side face thereof.

Side walls 26 are of substantially triangular shape in elevation and are attached at their lower, rearward ends to the side edges of foot bed plate 24, adjacent the rearward end of the latter.

As best seen in FIGS. 5–8, the lower, forward ends of side walls 26 are unattached to foot bed plate 24 and are each separated from the foot bed plate by a triangular slot 28 in the side wall which communicates at its forward end with the rearward end of a somewhat L-shaped slot 30 disposed between the forward side edges of the foot bed plate and the forward end of each side wall 26.

The forward ends of side walls 26 form a pair of flat, spaced, horizontally inwardly-extending fingers 32 disposed on a plane with foot bed plate 24.

The adjacent ends of fingers 32 are separated by a slot 34 which communicates with one end of each L-shaped slot 30 disposed between the forward side edges of the foot bed plate and the forward end of each side wall 26.

Since side walls 26 of boot housing assembly 20 are attached to foot bed plate 24 only at their rearward ends, the forward ends of the side walls may be brought closer together or moved farther apart as desired, for purposes to appear.

Foot bed plate or platform 24 includes a heel portion 36, which is relieved or cut away as at 37 for weight reduction purposes, a mid portion 38 and a forward portion 40 which is separated by slots 30 from fingers 32 of side walls 26.

A plurality of upright anti-slip pins 42 is formed integrally with foot bed plate 24 on heel portion 36 and on forward portion 40 to provide stability and to preclude sliding of a boot relative to the foot bed plate.

As best seen in FIGS. 4 and 9–11, a substantially flat, rectangular adjustment plate 44 is superposed on foot bed plate 24 so as to overlie forward portion 40 and fingers 32.

A raised, rectangular land 46 on forward portion 40 of foot bed plate 24 which carries anti-slip pins 42 is receivable in a complemental cut-out 48 provided centrally of adjustment plate 44 and serves as a locator for the correct positioning of the adjustment plate, with a depending lip 50 on the forward end of the adjustment plate adapted to embrace the forward edges of fingers 32.

Adjustment plate 44 is secured in place by a pair of rear screws 52 which extend through a pair of spaced, aligned openings 54 in adjustment plate 44 and a pair of spaced, aligned openings 54' in foot bed plate 24, respectively and by a pair of forward screws 56 which extend through a pair of spaced, aligned openings 58 in adjustment plate 44 and a pair of spaced, aligned, transversely-extending slots 58' in fingers 32.

Spaced, aligned, transversely-extending rows 60 and 62 of ratchet teeth are provided on the bottom face of adjustment plate 44 and are disposed in spaced parallelism to lip 50.

Rows 60 and 62 of ratchet teeth on the adjustment plate are adapted to mesh with spaced aligned, transversely-extending rows 64 and 66 of ratchet provided on the upper faces of fingers 32.

As will appear, interengagement of the rows of ratchet teeth on adjustment plate 44 with the rows of ratchet teeth on fingers 32 assist in locking side walls 26 of boot housing assembly 20 in position relative to a boot.

As best seen in FIG. 2, adjustment plate screws 52 and 56 have retaining nuts 68 threaded thereon, the retaining nuts bearing against a retainer plate 70 disposed below foot bed plate 24 of boot housing assembly 20.

Adjustment plate screws 52 and 56 also extend through provided openings in crampon or cleat 72 which is sandwiched between retainer plate 70 and forward portion 40 of foot bed plate 24 of boot housing assembly 20.

Crampon 72 has downwardly-extending front teeth 74, rear teeth 76 and side teeth 78.

A pivot means 80 is provided for mounting boot housing assembly 20 for swinging movement relative to snow shoe frame 12.

Pivot means 80 includes a pivot pin 82 sleeved by a bearing 84 which extends transversely below forward portion 40 of foot bed plate 24 and above crampon 72.

Pivot pin 82 extends outwardly from each side wall of the foot bed plate in the form of closed loops 86.

Pivot means 80 is secured to snow shoe frame 12 by straps 88 which partially encircle frame 12, extend through closed loops 86 and are secured to deck 14 as by rivets 90.

As best seen in FIGS. 2, 3, 18 and 19, an integral heel crampon assembly 91 is provided immediately below heel portion 36 of foot bed plate 24 of boot housing assembly 20.

Integral heel crampon assembly 91 includes a pair of spaced, angularly disposed, preferably metallic crampons or cleats 92, a transversely-extending reinforcing strip or heel band 98 of resilient, semi-rigid plastic sheeting, and a rigid, transversely-extending, substantially rectangular heel plate 97.

Each crampon 92 is spaced inwardly from snowshoe frame 10 and has rows of teeth 96 which extend vertically downwardly below the plane of the snowshoe frame to penetrate the snow surface and inhibit lateral and horizontal sliding.

Reinforcing strip or heel band 98 is superposed on deck 14 above heel crampons 92 immediately below heel portion 36 of foot bed plate 24 and is secured to snowshoe frame 12 as by rivets 100, the reinforcing strip providing additional support for the rear end of boot housing assembly 20.

Heel plate 97 is disposed immediately below heel portion 36 of boot housing assembly 20 on the upper surface of heel band 98 and is sufficiently rigid to provide a "foundation" for mounting the pair of crampons 92.

Heel plate 97 also transmits the downward force of a user's weight directly to crampons 92, thereby ensuring that the crampons remain perpendicular to the snow surface.

Heel band 98 positions heel plate 97 and crampons 92 and transmits vertical and horizontal forces to frame 12.

Deck 14 is cut away or recessed at both side edges as at 93 to provide space for passage of teeth 96 of crampons 92, whereby the crampons are mounted to the outside of deck 14 and do not penetrate the deck.

Crampons 92 are mounted at an angle (preferably about 45° degrees) to the longitudinal axis of the snowshoe whereby the crampons counteract both lateral and axial forces, the Crampons 92 are secured to heel plate 97, heel band 98 and deck 14 by rivets 95 which extend downwardly through each member.

Figure 20:
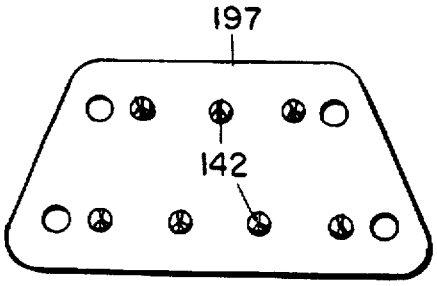
FIG. 20 is a top plan view of a modified form of heel plate.
Figure 21:
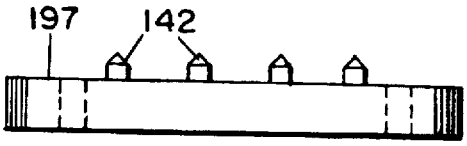
FIG. 21 is a front elevational view of the heel plate of FIG. 20.

FIG. 20 illustrates a modified form of heel plate 197 having a plurality of upright anti-slip pins 142 on its upper planar surface to preclude sliding of a boot if integral crampon assembly 91 is used in a snowshoe without a boot housing assembly.

Restraining means is provided on boot housing assembly 20 for firmly securing a boot within the housing assembly and includes an adjustable heel stop unit 102, an adjustable instep clamp assembly 104 and an adjustable, contoured toe strap unit 106.

Each of restraining means 102, 104 and 106 utilizes components of commercially available type and includes a strap having ratchet teeth on one surface which is engageable with a receptor which, unless it is depressed and released or "unlocked", permits sliding movement of the strap in only one direction.

Adjustable heel stop unit 102 includes a semi-rigid toothed strap 108 having one end pivoted at 110 to boot housing assembly 20 adjacent the rear end of one side wall 26 and having an opposite free end receivable in a receptor 112 pivoted at 114 to boot housing assembly 20 adjacent the rear end of the other side wall 26.

Adjustable toe strap unit 106 includes a semi-rigid toothed strap 116 having one end pivoted at 118 to boot housing assembly 20 adjacent the forward end of one side wall 26 and having an opposite free end receivable in a receptor 120 provided at the free end of a semi-rigid strap extension 122 which is pivoted at its opposite end at 124 to boot housing assembly 20 adjacent the forward end of the other side wall 26.

Strap 116 and strap extension 122 are preferably curved or contoured so as to easily embrace the curved contour of a boot toe.

Adjustable instep clamp unit 104 includes a semi-rigid toothed strap 123 having one end fixed to a combination toggle buckle/actuating lever and latch assembly 124 pivoted at 126 to boot housing assembly 20 adjacent the approximate midsection of one side wall 26 and having an opposite free end receivable in a receptor 128 pivoted at 130 to boot housing assembly 20 adjacent the approximate midsection of the other side wall 26.

A resilient pad 132 sleeved on toothed strap 122 may be strategically placed over the instep of a boot to cushion the instep from the strap.

As best seen in FIGS. 14–17, toggle buckle/actuating lever and latch assembly 124 includes a latch plate 134 attached by pivot 126 to side wall 26, a bifurcated actuating lever 136 pivoted at one end at 138 to latch plate 134, a latch 140 pivoted at 142 to the opposite end of actuating lever 136 and a bifurcated buckle 144 pivoted at 146 to actuating lever 136 approximately centrally of the latter, with one end of toothed strap 123 being fixed to and extending outwardly from buckle 144.

A first locking finger 148 on latch 140 is releasably engageable with a second locking finger.150 which extends outwardly from latch plate 134 to lock actuating lever 136 and the end of toothed strap 123 in place relative to boot housing assembly side wall 26.

Locking fingers 148 and 150 may be easily disengaged simply by rotating latch 140 relative to pivot 142, permitting actuating lever 136 to be rotated relative to pivot 136 to loosen toothed strap 123 relative to a boot instep.

Combination toggle buckle/actuating lever and latch assembly 124 permits instep strap unit 104 to be loosened while one end of toothed strap 122 remains fixed to one side wall 26 of boot housing assembly 20.

The snowshoe binding of the invention not only retains the boot heel, but offers a means to prevent "black toe", by resisting foot movement during descents.

Semi-rigid boot housing assembly 20 encloses the boot on either side and bottom of the foot, extending to the heel area and upward to the ankle area.

Foot bed plate or platform 24 and side walls 26 extend the lateral rigidity from the snowshoe axle to the heel area.

Adjustable heel stop unit 104 attached to boot housing assembly 20 ensures that the ball of the foot is positioned directly over the snowshoe axle.

Instep clamp unit 104 attached to side walls 26 is designed to comfortably restrain the foot, with the restraining loading force being applied perpendicular to the boot upper (instep) area.

Boot housing assembly 20 incorporates a width adjustment system which allows the user to pre-set the proper width in the "ball-of-foot" area. The assembly has sets of spaced ratchet teeth in close proximity to adjustment slots. The ratchet teeth intermesh with mating ratchet teeth on adjustment plate 44. The entire assembly is held together with screws 54 and 56 which pass through the adjustment plate through the slots in foot bed plate 24 and through clearance holes in crampon or cleat 72 to locking nuts 68. By loosening screws 54 and 56 the user may adjust the semi-rigid binding side walls 26 to be snug with the boot. This would be considered a one time set-up for a new user.

The invention incorporates a rugged ratchet strap assembly with actuating lever which allows the user to exert substantial binding force toward the heel stop assembly. A retainer latch is used in conjunction with the ratchet strap to adjust for boot size changes. A locking toggle buckle assembly is used to tighten and lock the binding. The system is easily adjusted from snug fit used on flat ground to a tight fit for steep descents. "Comfort" pad 132 is provided to prevent discomfort in the instep area.

We claim:

1. A snowshoe comprising a frame, a resilient deck on the frame, a semi-rigid boot housing assembly pivotally connected to the frame, an adjustable heel stop assembly, an adjustable instep clamp assembly and an adjustable toe strap unit each attached to the boot housing assembly, and an integral heel crampon assembly attached to the frame, the boot housing assembly extending to the boot heel and ankle area of a user and being adapted to enclose the sides and bottom of the boot of a user, the adjustable heel stop assembly being engageable by the heel of the boot for properly positioning the boot relative to the frame, the adjustable instep clamp assembly being engageable with the instep of the boot of a user, the adjustable toe strap unit extending transversely across and engageable with the top of the toe of the boot of a user, the instep clamp assembly and the toe strap unit urging the boot rearwardly against the heel stop assembly, the integral heel crampon assembly being positioned below the boot housing assembly and boot heel of a user and attached to the resilient deck.

2. A snowshoe according to claim 1, wherein the boot housing assembly includes a substantially flat boot bed plate for supporting the heel and ball of foot areas of a boot, semi-rigid, upstanding, longitudinally-extending side walls on the foot bed plate and extending the length thereof for providing lateral rigidity for the ankle areas of a boot, and width adjustment means permitting adjustments of the width of the boot housing assembly to fit the boot of a user.

3. A snowshoe according to claim 2, wherein the width adjustment means comprises each said side wall having one end fixed to the foot bed plate and having an opposite free end, each free end having an inwardly extending finger disposed outwardly of and on a plane with the foot bed plate, and an adjustment plate releasably secured to the foot bed plate and to the fingers.

4. A snowshoe according to claim 3, wherein the adjustment plate is releasably secured to the foot bed plate and to the fingers by threaded fasteners which extend through provided openings in the foot bed plate and fingers and have nuts threaded thereon.

5. A snowshoe according to claim 4, wherein the openings in the fingers are slots.

6. A snowshoe according to claim 4, including ratchet teeth on the adjustment plate which intermesh with ratchet teeth on the fingers for locking the fingers in a preset position.

7. A snowshoe according to claim 1, wherein the heel stop assembly, the instep clamp assembly, and the toe strap unit each include a toothed strap pivoted at one end to the boot housing assembly and having an opposite free end releasably engageable with a receptor pivoted to the boot housing assembly.

8. A snowshoe according to claim 1, wherein the instep clamp assembly includes a toothed strap fixed at one end to a combination toggle buckle/actuating lever and latch assembly pivoted to the boot housing assembly and having an opposite free end releasably engageable with a receptor pivoted to the boot housing assembly.

9. A snowshoe according to claim 8, including a pad on the toothed strap for cushioning the instep of a user.

10. A snowshoe according to claim 1, including a crampon fixed to and depending from the boot housing assembly and having teeth disposed on a plane below the plane of the frame.

11. A snowshoe according to claim 1, including anti-slip pins on the boot housing assembly engageable by the bottom of the boot of a user.

12. A snowshoe according to claim 1, wherein the integral heel crampon assembly comprises a pair of spaced, angularly disposed crampons, a transversely-extending resilient, semi-rigid heel band, and a rigid, transversely-extending heel plate.

13. A snowshoe according to claim 12, wherein each crampon is spaced inwardly from the snowshoe frame and has rows of teeth which extend vertically downwardly below the plane of the snowshoe frame to penetrate the snow surface and inhibit lateral and horizontal sliding.

14. A snowshoe according to claim 12, wherein the heel band is superposed on the deck above the heel crampons and immediately below the heel portion of the boot housing assembly and is secured to the snowshoe frame for providing additional support for the rear end of the boot housing assembly.

15. A snowshoe according to claim 12, wherein the heel plate is disposed immediately below the heel portion of the boot housing assembly on the upper surface of the heel band and is sufficiently rigid to provide a foundation for mounting the pair of crampons.

16. A snowshoe according to claim 12, wherein the deck is cut away at both side edges to provide space for passage of the crampons, whereby the crampons are mounted to the outside of the deck and do not penetrate the deck.

17. A snowshoe according to claim 12, wherein the crampons are mounted at an angle to the longitudinal axis of the snowshoe whereby the crampons counteract both lateral and axial forces.

18. A snowshoe according to claim 12, wherein the crampons are secured to the heel plate, the heel band and the deck by rivets which extend downwardly through each member.

* * * * *